US006402532B1

(12) United States Patent
Ko

(10) Patent No.: US 6,402,532 B1
(45) Date of Patent: Jun. 11, 2002

(54) PRESSING BAR FOR CONNECTING LEGS OF CONNECTORS

(75) Inventor: Sheng-Ching Ko, Taipei (TW)

(73) Assignee: Jess -Link Products Co., Ltd., Taipei (TW)

( * ) Notice: Subject to any disclaimer, the term of this patent is extended or adjusted under 35 U.S.C. 154(b) by 0 days.

(21) Appl. No.: 09/886,024

(22) Filed: Jun. 22, 2001

(51) Int. Cl.[7] ..... H01R 4/66
(52) U.S. Cl. ..... 439/108; 439/29; 439/80
(58) Field of Search ..... 439/108, 569, 439/573, 620, 79, 59, 660, 80

(56) References Cited

U.S. PATENT DOCUMENTS 6,033,263 A * 3/2000 Weidler et al. ..... 439/620
6,155,843 A * 12/2000 Tung ..... 439/64
6,171,142 B1 * 1/2001 Wang et al. ..... 439/567
6,231,355 B1 * 5/2001 Trammel et al. ..... 439/79

* cited by examiner

*Primary Examiner*—Tho D. Ta
*Assistant Examiner*—Phuongchi Nguyen
(74) *Attorney, Agent, or Firm*—Jacobson Holman, PLLC

(57) ABSTRACT

A pressing bar for connecting legs of connectors includes a connector with a plurality of slots. A sleeve is inside each slot with a connecting leg that is soldered on a connecting point of a circuit board. The connecting legs are further fixed onto the circuit board with a pressing bar. The pressing bar includes a pair of pressing ears on both ends and a plurality of troughs on the bottom. A fastening hole is on both ends of the connector. By placing the pressing ear of the pressing bar into the fastening holes of the connector, the pressing bar is fixed on top of the connector and the troughs of the pressing bar are firmly attached on top of the connecting legs of the sleeves. Thus the connecting legs are pressed on top of the connecting points so as to avoid bad connections and open circuit conditions.

3 Claims, 7 Drawing Sheets

PRESSING BAR FOR CONNECTING LEGS OF CONNECTORS

BACKGROUND OF THE INVENTION

I. Field of the Invention

This invention relates generally to a pressing bar for connecting legs of connectors and, more specifically, to a pressing bar for connecting legs of connectors that fastens the connecting legs of the connectors on the connecting points of circuit boards to avoid a bad connection from happening.

II. Description of the Prior Art

Heretofore, it is known that most of the connectors for computers and appliances are made of a plastic base with a plurality of slots, each slot having a sleeve internally, the connectors soldered on connecting through holes of a circuit board for connection.

The physical size of connectors are getting smaller and smaller, but the number of sleeves do not decrease, therefore the through hole type connectors are gradually replaced by surface mount device (SMD) technology type. The connecting legs of the sleeves are soldered on the connecting points directly.

The physical size of the new SMD type of connectors is very small. The sleeves are aligned at a very close distance. Most of the sleeves are stacked above and below. The connecting legs in the back of the sleeves are bent up easily. Therefore when the sleeves are placed into the connectors, the connecting legs might not be in the same plane. This condition causes some of the connecting legs to not attach to the connecting point of the circuit board. This condition further results in a bad connection.

The sleeves of the connectors are aligned closely. Therefore the connecting legs tend to short together easily, or miss the alignment causing the connecting legs to miss the connecting point of the circuit board resulting in bad or missed connection.

SUMMARY OF THE INVENTION

It is therefore a primary object of the invention to provide a pressing bar for connecting legs of connectors that applies a pressing bar to fix the connecting legs of a connector on the corresponding connecting points on a circuit board to reduce bad connection problems.

In order to achieve the objective set forth, a pressing bar for connecting legs of connectors in accordance with the present invention comprises a connector with a plurality numbers of slots. A sleeve is inside of each slot. On the back of the sleeve is a connecting leg that is soldered on the connecting point of the circuit board with SMD technology. The connecting legs are further fixed onto the circuit board with a pressing bar. The pressing bar is composed of a metal plate and a plastic bar; A pair of pressing ear is on both ends of the pressing bar. A plurality of troughs are on the bottom of the pressing bar. A fastening hole is on both ends of the connector. By placing the pressing ear of the pressing bar into the fastening hole of the connector, the pressing bar is fixed on top of the connector and makes the trough of the pressing bar firmly attached on top of the connecting leg of the sleeve. The connecting legs of the connector are pressed firmly on top of the connecting point of the circuit board. Such a structure can avoid a bad connection and open circuit conditions.

BRIEF DESCRIPTION OF THE DRAWINGS

The accomplishment of the above-mentioned object of the present invention will become apparent from the following description and its accompanying drawings which disclose an embodiment of the present invention, and are as follows.

DESCRIPTION OF THE PREFERRED EMBODIMENT

Figure 1:
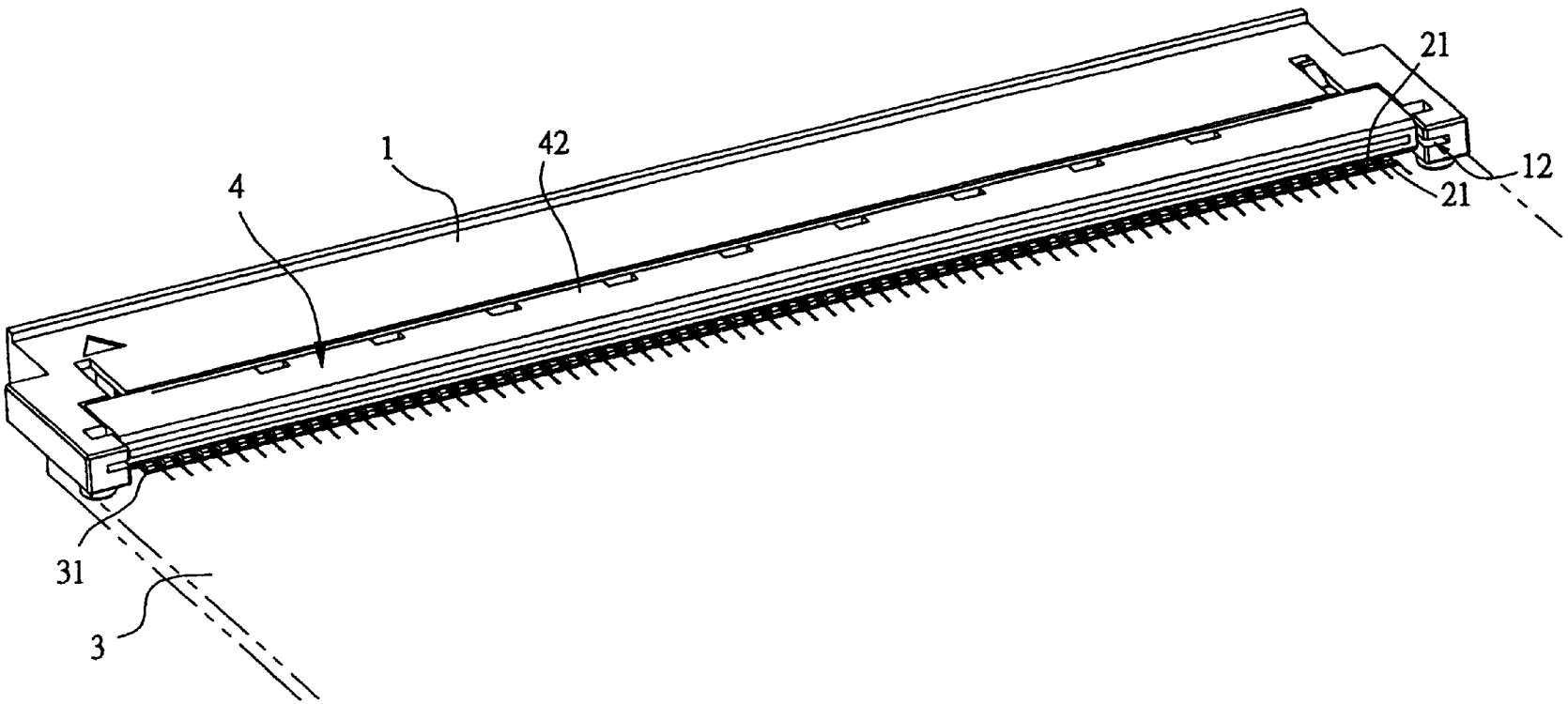
FIG. 1 is a perspective view of the present invention.
Figure 2:
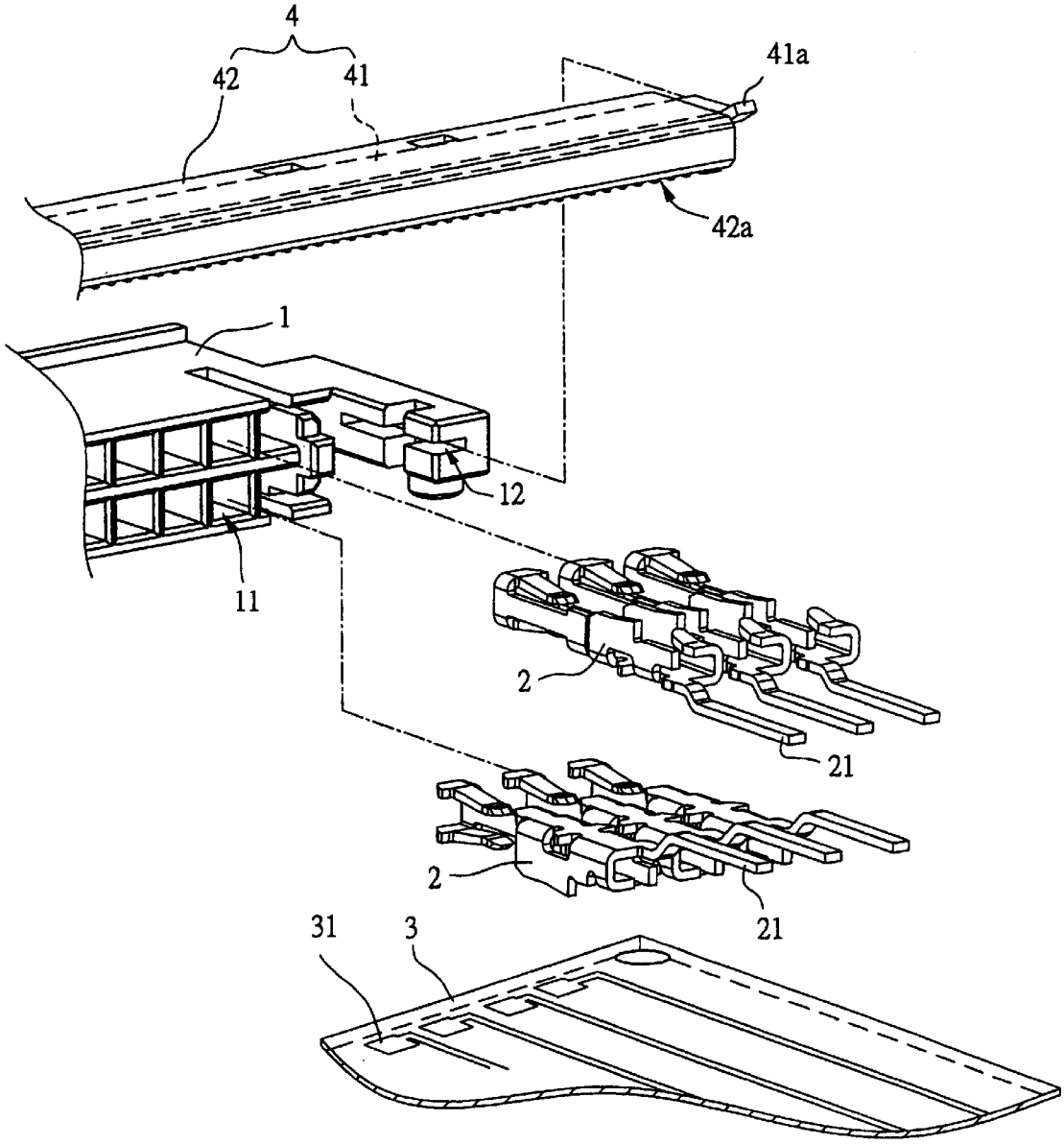
FIG. 2 is an exploded view of the present invention.

Referring to FIG. 1 and FIG. 2, the present invention is composed of a connector 1 with a plurality of slots 11; a sleeve 2 is inside of each slot 11. On the back of the sleeve 2 is a connecting leg 21 which is soldered on the connecting spot 31 of the circuit board 3 with SMD technology The connecting legs 21 are further fixed onto the circuit board 3 with a pressing bar 4. The pressing bar 4 is composed of a metal plate 41 and a plastic bar 42. A pair of pressing ears 41*a* is located on both ends of the pressing bar 4. A plurality of troughs 42*a* are on the bottom of the pressing bar 4. A fastening hole 12 is on both ends of the connector 1.

Figure 3:
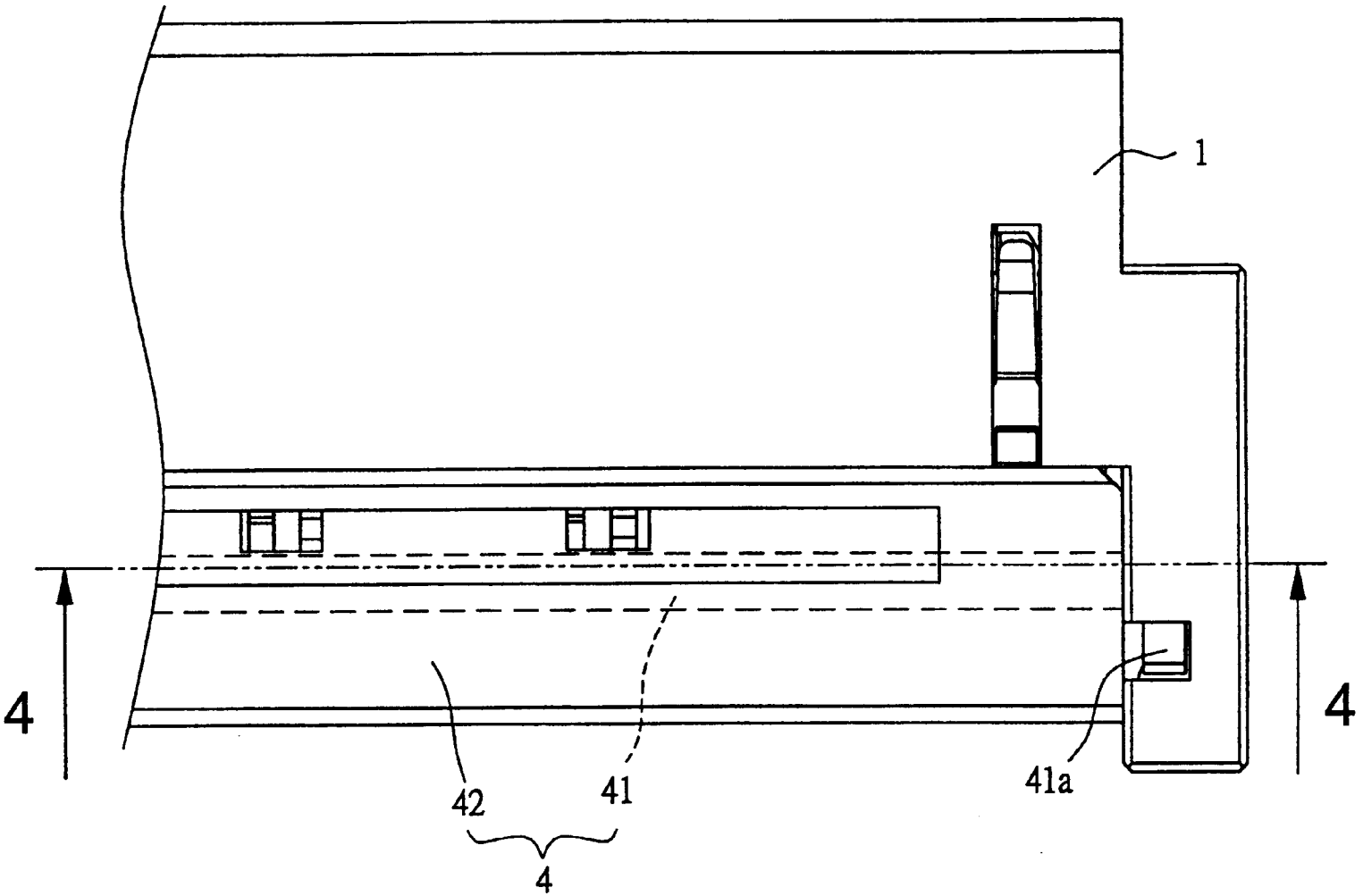
FIG. 3 is a partial top view of the present invention.
Figure 4:
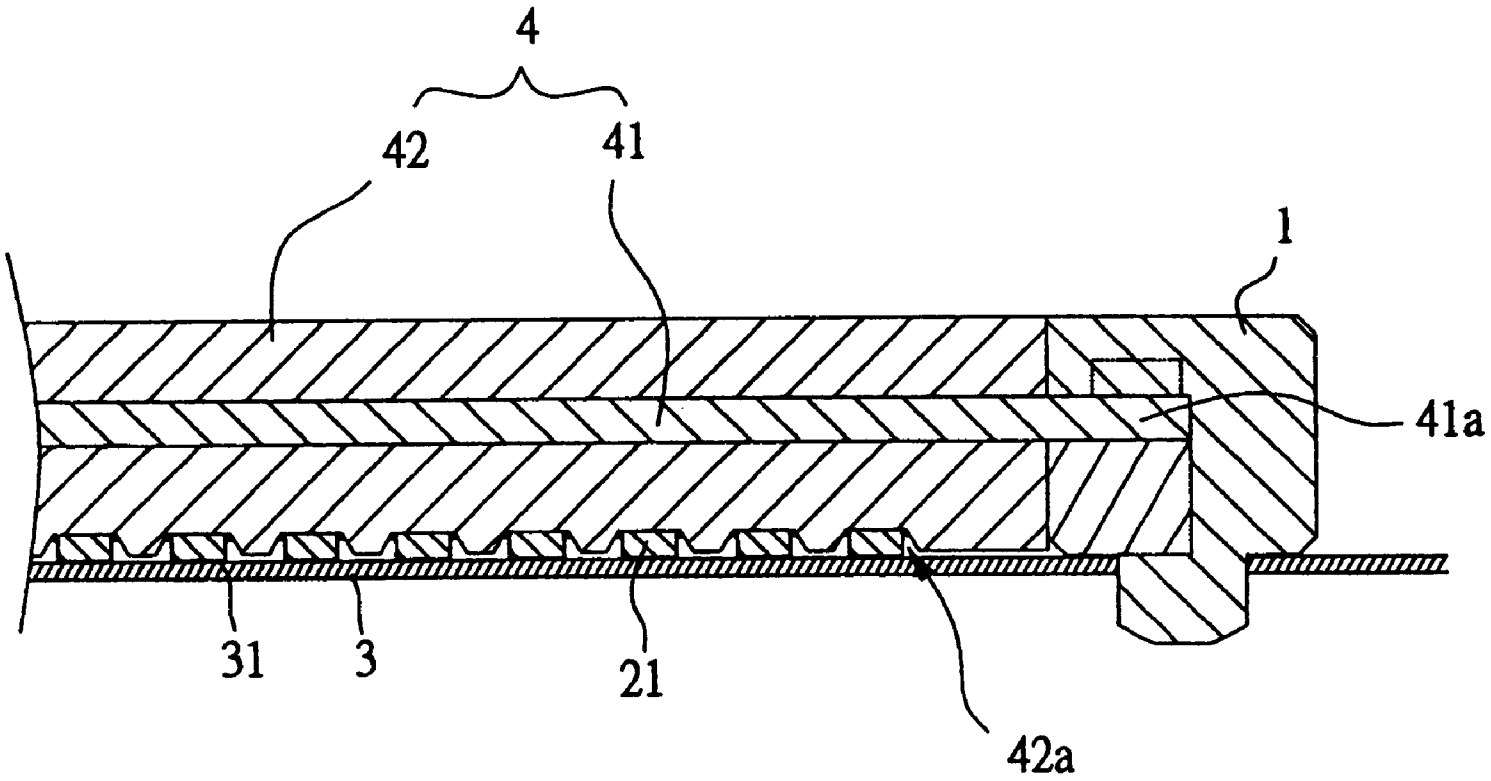
FIG. 4 is a cross sectional view of the present invention taken along line 4—4 of FIG. 3.

Referring to FIG. 3 and FIG. 4, by placing the pressing ear 41*a* of the pressing bar 4 into the fastening hole 12 of the connector 1 to fix the pressing bar 4 on top of the connector 1, the troughs 42*a* of the pressing bar 4 are firmly attached on top of the connecting legs 21 of the sleeves 2. The connecting legs 21 of the connectors 2 are pressed firmly on top of the connecting point of the circuit board 3 to avoid a bad connection and open circuit conditions.

Based on the above description, since the connecting legs 21 of the connectors 2 are firmly fixed inside the troughs 42*a* of the pressing bar 4, such arrangement can make the connecting legs 21 of the connectors 2 align properly to avoid a mismatch condition.

The connecting legs 21 of the connectors 2 can be pressed firmly on the connecting point 31 of the circuit board 3. Therefore the bad connection with the connecting point 31 of the circuit board can be also avoided.

Figure 5:
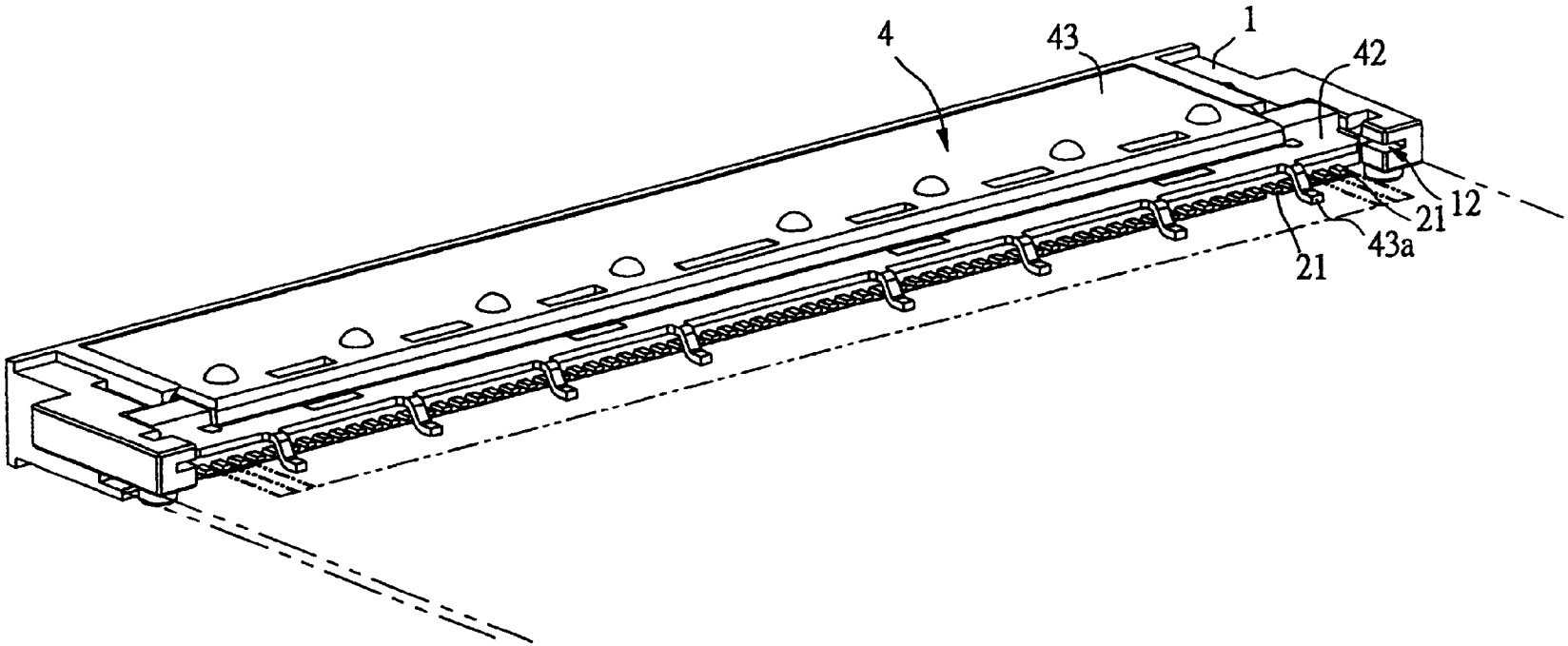
FIG. 5 is a perspective view of a further embodiment of the present invention.
Figure 6:
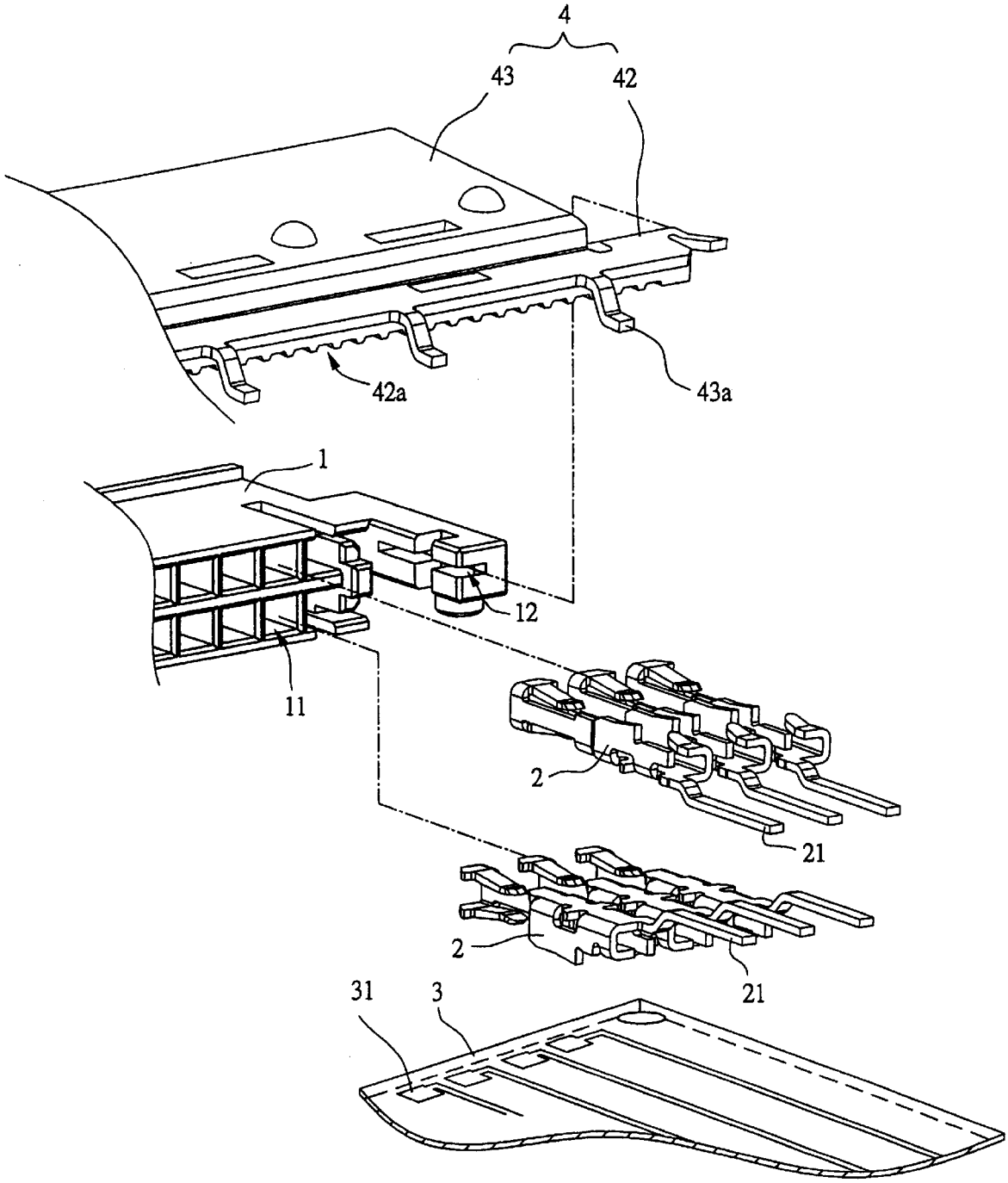
FIG. 6 is an exploded view of a further embodiment of the present invention.

Following is another application of the present invention, referring to FIG. 5 and FIG. 6, the metal plate 41 can be designed as a larger area grounding plate 43, as required. A plurality of grounding leg 43*a* are on the back of the grounding plate 43. The connector 2 can be shielded by ground to the grounding plate 43.

Figure 7:
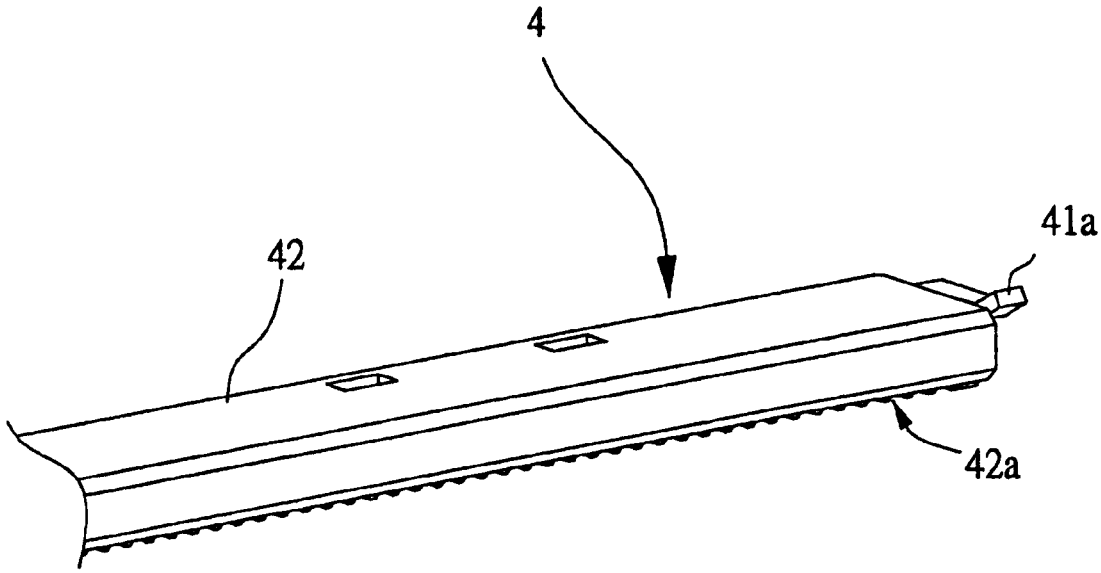
FIG. 7 is a perspective view of a further embodiment of the present invention.

Following is another application of the present invention, referring to FIG. 7, the pressing bar 4 is only a plastic bar 42. A pressing ear is on both ends. A plurality of troughs 42*a* are on the bottom. Such a scheme can also achieve the same result.

While a preferred embodiment of the invention has been shown and described in detail, it will be readily understood and appreciated that numerous omissions, changes and additions may be made without departing from the spirit and scope of the invention.

What is claimed is:

1. A pressing bar assembly for connecting legs of connectors, said pressing bar assembly comprising:

a connector with a plurality of slots, a sleeve inside of each said slot, a connecting leg of each sleeve soldered on a connecting spot of a circuit board by SMD technology, a pressing bar, a pair of pressing ears on both ends of said pressing bar, a plurality of troughs on a bottom of the pressing bar aligned for receipt of said connecting leg of each said sleeve, and a fastening hole on both ends of said connector receiving said pair of pressing ears of said pressing bar to press said connecting leg of each said sleeve downwardly toward and into engagement with said circuit board for a secure connection with said connecting spot of said circuit board.

2. The pressing bar assembly as recited in claim 1, wherein said pressing bar is connected to ground with a plurality of grounding legs on a back of a metal plate.

3. The pressing bar assembly as recited in claim 1, wherein said pressing bar is a plastic bar.

* * * * *